US007377036B2

(12) United States Patent
Johnson et al.

(10) Patent No.: US 7,377,036 B2
(45) Date of Patent: May 27, 2008

(54) METHODS FOR TUNING FUEL INJECTION ASSEMBLIES FOR A GAS TURBINE FUEL NOZZLE

(75) Inventors: Jere A. Johnson, Greenville, SC (US); Mark J. Bailey, Simpsonville, SC (US); Mark D. Pezzutti, Mason, OH (US); James Christopher Monaghan, Moore, SC (US); Ron Souther, Campobello, SC (US); Robert R. Berry, Anderson, SC (US)

(73) Assignee: General Electric Company, Schenectady, NY (US)

( * ) Notice: Subject to any disclaimer, the term of this patent is extended or adjusted under 35 U.S.C. 154(b) by 598 days.

(21) Appl. No.: 10/957,575

(22) Filed: Oct. 5, 2004

(65) Prior Publication Data

US 2006/0070237 A1 Apr. 6, 2006

(51) Int. Cl.
*B23P 6/00* (2006.01)
*F02C 1/00* (2006.01)
*F01D 5/14* (2006.01)

(52) U.S. Cl. ..... 29/889.1; 29/889.21; 29/889.22; 29/401.1; 60/742; 60/780; 415/115; 416/181

(58) Field of Classification Search ..... 29/401.1, 29/402.13, 402.16, 888.011, 889.21, 889.22, 29/889.721, 889.1, 890.142; 60/740, 742, 60/743, 772, 780, 773; 415/48, 115, 148, 415/191, 200, 209.4, 210.1; 416/181
See application file for complete search history.

(56) References Cited

U.S. PATENT DOCUMENTS

| | | | | |
|---|---|---|---|---|
| 5,111,570 | A * | 5/1992 | Baumgarten et al. | 29/402.13 |
| 5,685,139 | A * | 11/1997 | Mick et al. | 60/776 |
| 6,243,948 | B1 * | 6/2001 | Lee et al. | 29/889.1 |
| 6,265,022 | B1 * | 7/2001 | Fernihough et al. | 427/142 |
| 6,370,752 | B1 * | 4/2002 | Anderson et al. | 29/402.11 |
| 6,413,650 | B1 * | 7/2002 | Dupree et al. | 428/579 |
| 6,892,931 | B2 * | 5/2005 | Steplewski et al. | 228/119 |
| 6,918,742 | B2 * | 7/2005 | Liang | 415/115 |
| 7,192,622 | B2 * | 3/2007 | Fernihough et al. | 427/157 |

* cited by examiner

*Primary Examiner*—David P. Bryant
*Assistant Examiner*—Alexander P Taousakis
(74) *Attorney, Agent, or Firm*—Nixon & Vanderhye, PC

(57) ABSTRACT

A fuel nozzle assembly for a gas turbine includes a plurality of circumferentially spaced vanes with holes for flowing fuel from plenums within the vanes through holes in the vane walls for premixing with air. To tune the nozzle assembly, the holes are resized by reforming the existing holes to a predetermined hole size, securing plugs into the holes, and forming holes through at least certain of the plugs to diameters less than the diameter of the existing holes.

20 Claims, 4 Drawing Sheets

METHODS FOR TUNING FUEL INJECTION ASSEMBLIES FOR A GAS TURBINE FUEL NOZZLE

BACKGROUND AND BRIEF DESCRIPTION OF THE INVENTION

The present invention relates to methods for tuning gas turbine fuel nozzle assemblies and particularly relates to methods for resizing premix fuel inlet holes for supplying gaseous fuel for premixing with air within the nozzle assemblies.

In land based gas turbines, a fuel nozzle typically comprises a subassembly of generally concentric tubes defining a central passage for supplying diffusion fuel gas and a pair of concentric passages for supplying premix fuel gas. Spaced from and surrounding the subassembly is an inlet flow conditioner for directing and confining a flow of inlet air past a plurality of circumferentially spaced vanes carried by the subassembly. The vanes are in communication with the concentric fuel gas supply passages. Particularly, the vanes include outer premix holes and inner premix holes for supplying gas from the respective passages for mixing with the inlet air. The gas fuel mixture is swirled by the vanes downstream of the fuel inlet holes for subsequent combustion.

The gas fuel composition and Wobbe Index at site locations determine the fuel gas nozzle exit velocity requirement which in turn is dependent upon the fuel gas supply hole size. Where the supply holes are too large, for a given gas composition and Wobbe Index, nozzle dynamics become a concern. For example, if the gas composition changes, these concerns become real and the nozzle assembly must be retuned to preclude those dynamic concerns.

In accordance with an example of the present invention and in a fuel nozzle assembly for a gas turbine having a plurality of circumferentially spaced vanes with holes for flowing fuel for premixing with air within the nozzle assembly, there is provided a method of tuning the fuel nozzle assembly by changing the diameter of the premix fuel holes in the vanes. To accomplish this, the existing holes are reformed to a predetermined diameter. Plugs are inserted into the reformed holes and secured to the vanes. Holes are formed through at least three of the plugs to diameters less than the diameter of the existing holes. Thus, the original holes are resized to provide smaller holes with consequent desired tuning effects.

DETAILED DESCRIPTION OF THE INVENTION

Figure 1:
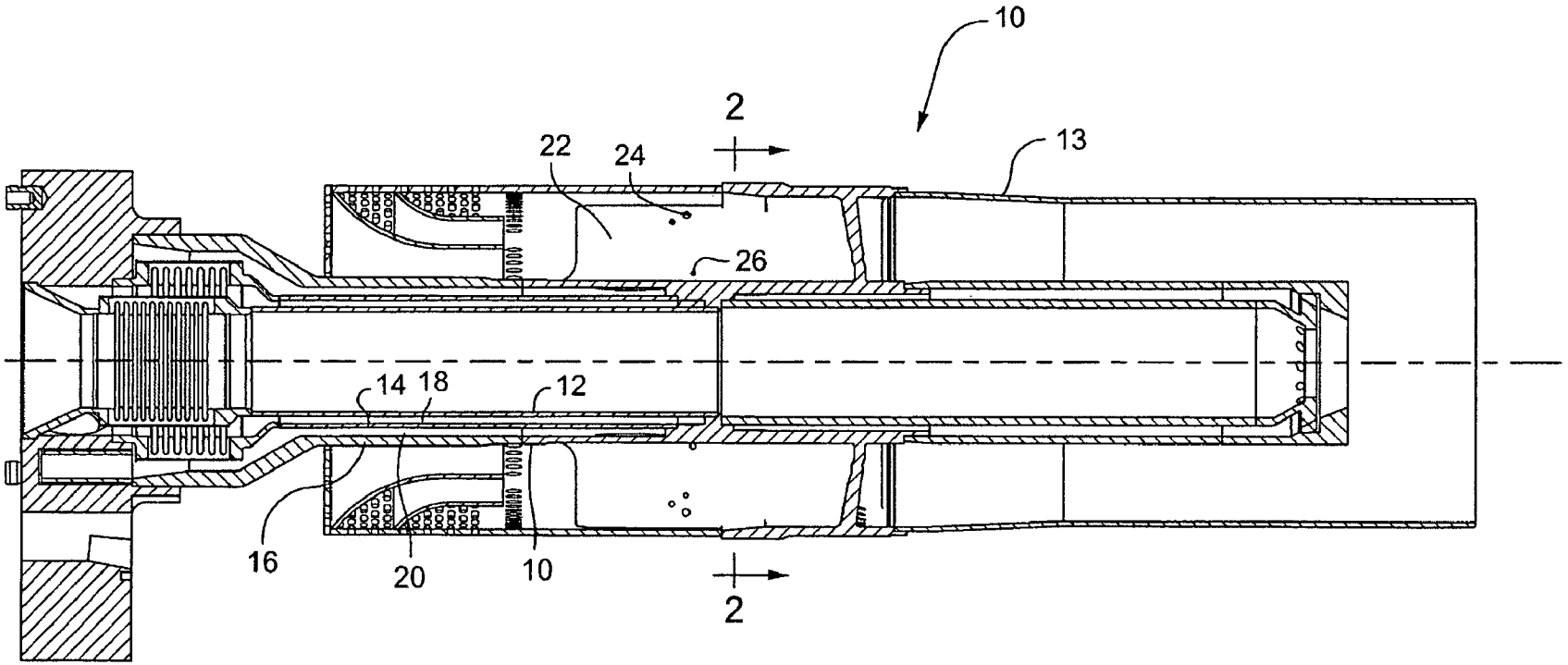
Fig. 1 (PRIOR ART)
FIG. 1 is a cross sectional view of a typical fuel nozzle assembly for a gas turbine.
Figure 2:
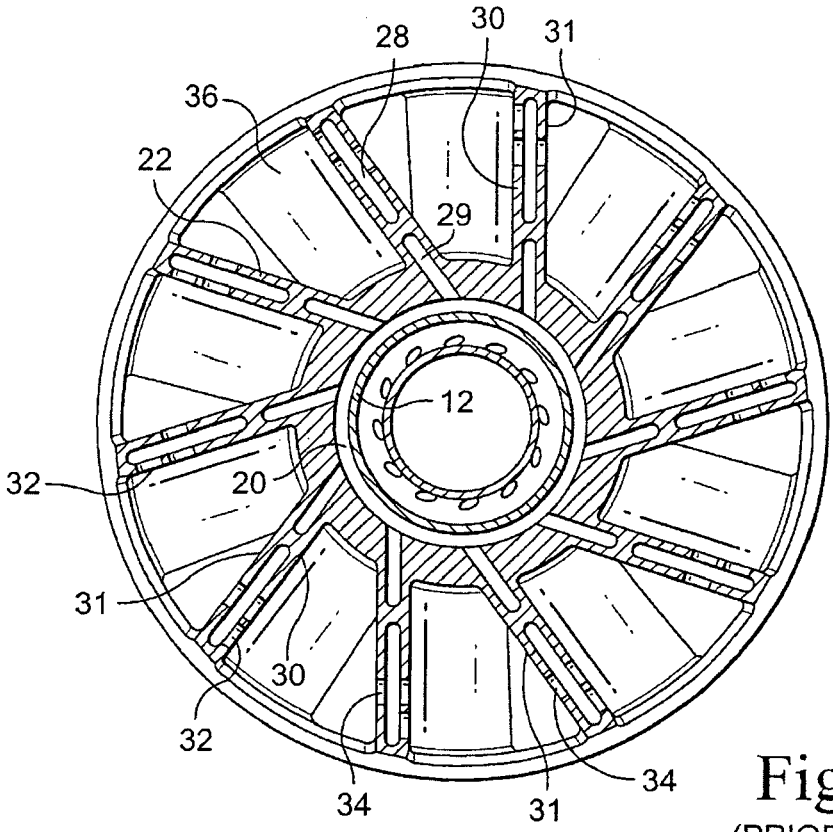
Fig. 2 (PRIOR ART)
FIG. 2 is a cross sectional view thereof taken generally about on line 2-2 in FIG. 1 illustrating existing premix fuel gas supply holes in the walls of the vanes.
Figure 3:
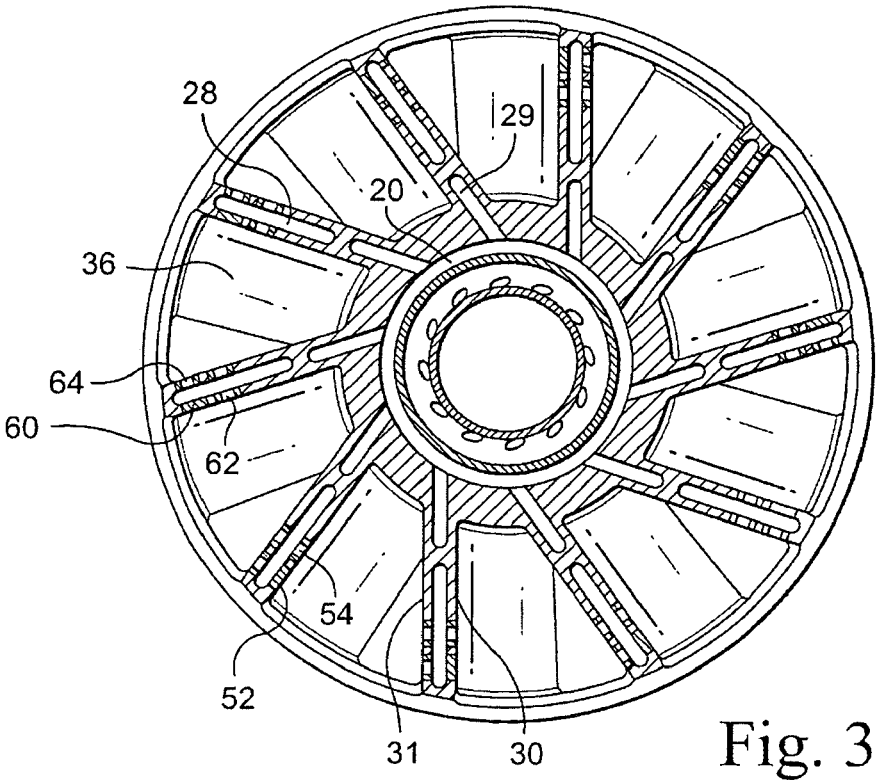
FIG. 3 is a view similar to FIG. 2 illustrating premix resized fuel gas supply holes in accordance with an aspect of the present invention.
Figure 4:
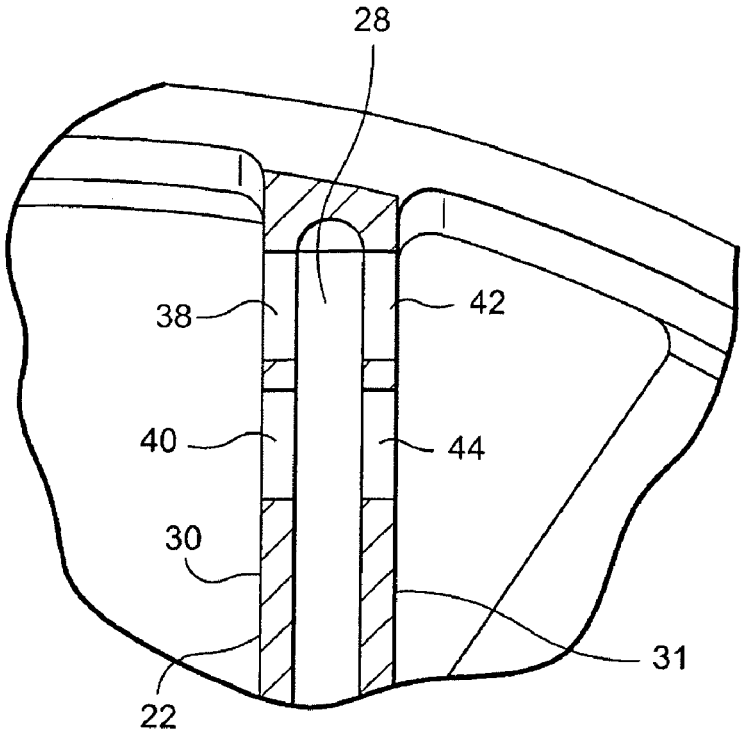
FIG. 4 is an enlarged cross sectional view of enlarged outer premix holes for a vane and forming part of a method of tuning the fuel injection assemblies according to an aspect of the present invention.
Figure 5:
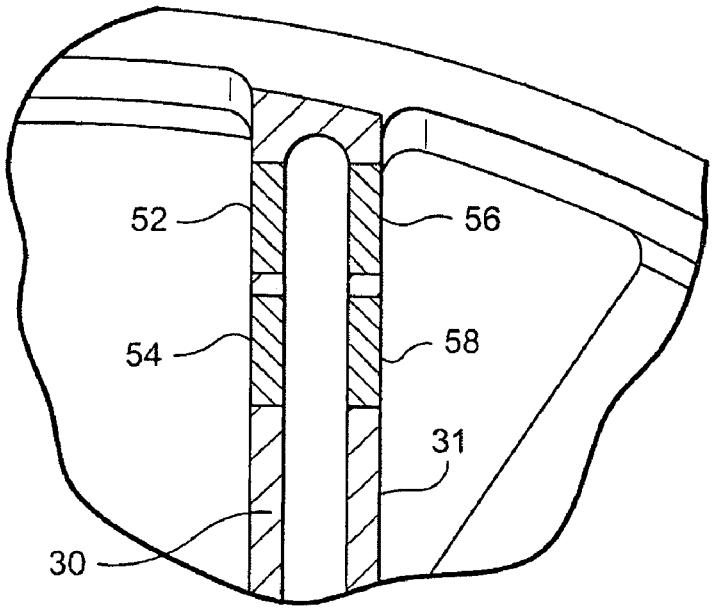
FIG. 5 is a view similar to FIG. 4 illustrating plugs disposed in the reformed holes.
Figure 6:
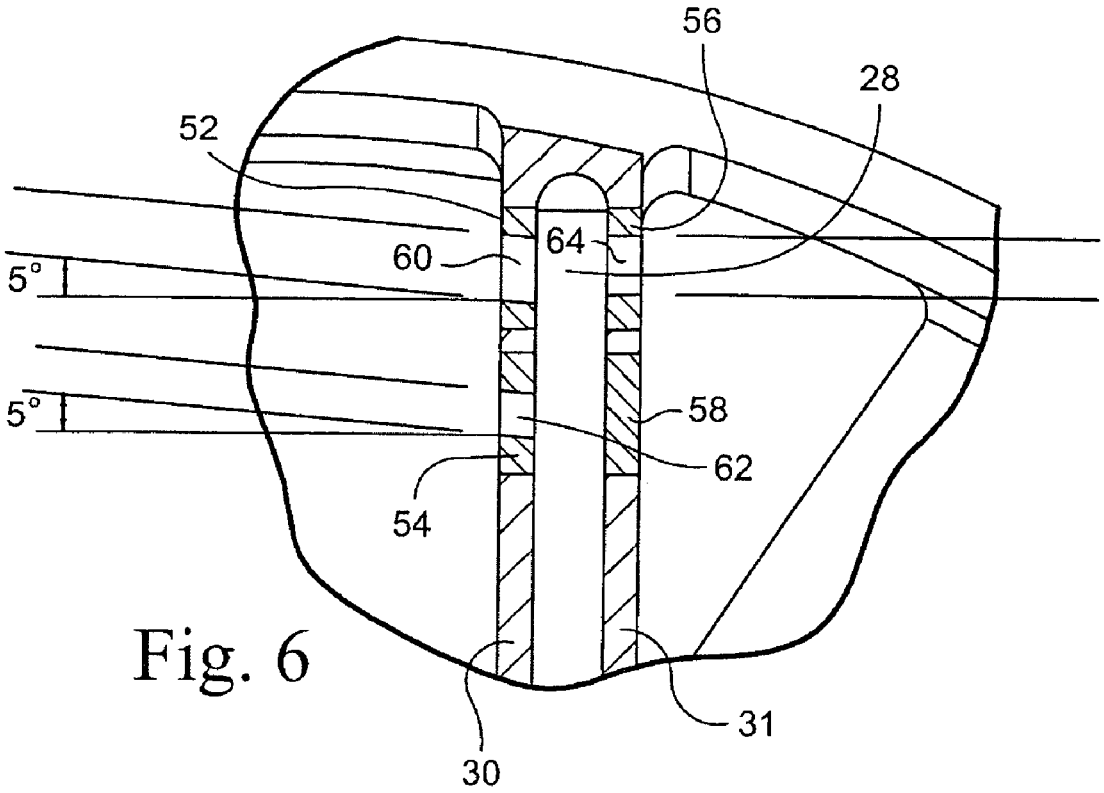
FIG. 6 is a view similar to FIG. 5 illustrating the resized fuel supply holes.

Referring now to FIG. 1, there is illustrated a conventional fuel nozzle assembly generally designated 10 for a gas turbine. Generally, the fuel nozzle assembly includes a subassembly 11 and a surrounding air inlet conditioner 13. Subassembly 11 includes a central tube 12 and a pair of concentric tubes 14 and 16 defining discrete annular fuel passages 18 and 20 respectively between tubes 12 and 14 and tubes 14 and 16. The central tube 12 supplies diffusion gas to the combustion zone downstream, not shown, of the fuel nozzle assembly 10. Arranged about the outer tube 16 and forming part of subassembly 11, there are provided a plurality of vanes 22 circumferentially spaced one from the other. The vanes 22 include outer premix holes 24 supplied with gaseous fuel from the passage 20 and a plurality of inner premix gas supply holes 26 supplied with gaseous fuel from passage 18. As best seen in FIGS. 2 and 3, each vane 22 has a pair of outer and inner plenums 28 and 29, respectively, confined between opposite side walls 30 and 31 of the vane. It will be appreciated that the holes 24 and 26 lie in communication with the outer and inner plenums 28, 29, respectively.

As illustrated in FIG. 2, the conventional outer premix gas supply holes 24 include a pair of radially spaced holes 32 through one wall 30 of the vane 22 and a single hole 34 through the opposite side wall 31 of the vane. Downstream portions 36 of the vanes are twisted to impart a swirl to the flow of premixed air and gaseous fuel flowing between the subassembly 11 and the inlet flow conditioner 13, the gaseous fuel being supplied to the air stream via the outer and inner premix fuel holes 24 and 26, respectively. As noted previously, it is sometimes necessary to retune the nozzle injector assemblies because of dynamic concerns.

To accomplish the foregoing, and particularly to provide resized fuel supply holes in the vanes, for example to provide smaller diameter holes in lieu of the existing gas supply holes 32 and 34 in the side walls 30 and 31, respectively, of the vanes, the inlet flow conditioner 13 which surrounds the vanes and other portions of the nozzle subassembly is removed. The inlet flow conditioner is preferably cut into two semi-circular pieces and discarded. By removing the inlet flow conditioner 13, the outer premix holes 24 in the vanes 22 are exposed.

The exposed outer premix holes are initially enlarged by an electro-discharge machining process to form a pair of holes through each of side walls 30 and 31. For example a pair of holes 38 and 40 are formed through side walls 30 of each vane and a pair of holes 42 and 44 are formed through side walls 31 of each vane. Using electro-machining processes enables the aligned holes 38, 42 to be formed in one pass. Similarly, the aligned holes 40, 44 may form in one pass. Consequently, the existing pair of holes 32 on one vane wall 30 are enlarged by electro-discharge machining and the existing single hole 34 in the opposite vane wall 31 is likewise enlarged. The second hole 42 in the opposite wall 31 of the vane 22 is formed by passing the electro-discharge machining tool through the hole 38 in the first wall in the aforementioned single pass. In this manner, a pair of holes in each wall is formed in alignment with a pair of holes in the opposite wall, and the holes 38, 40, 42 and 44 are larger than the existing holes 32 and 34. The holes 38, 40, 42 and 44 thus formed are then reamed preferably by hand using a carbide reamer and reaming guide to meet the required diameter for installation of plugs. Thus, the four enlarged holes in each vane, there being 10 vanes in the illustrated preferred embodiment, are each hand reamed to provide a slightly larger diameter hole. The hole diameters are preferably identical. After reaming the holes to remove burrs and cleaning the holes, for example, with acetone, the holes are degreased, e.g., in a solution of Metal Medic 7705 or equivalent, for approximately 30 minutes at 160° F. The vanes are rinsed, for example, by submergence in a warm water bath for about 10 minutes, air-dried, preferably using compressed air to remove the water from the holes an then oven-dried, for example, at temperatures between 1850° F.-1875° F. for approximately 30 to 60 minutes. After cleaning the holes with acetone, the holes are ready to receive plugs.

The plugs 50, 52, 54, 56 are secured preferably by brazing, to the walls of the vanes. Thus, after cleaning the plugs with acetone, each plug is installed into a reamed hole to lie flush with the vane surface. A small bead of brazed alloy paste is applied around the braze plugs. To complete the brazing process, the nozzle assembly is placed in a furnace which is then evacuated, e.g., to a vacuum of $5\times10^{-4}$ Torr or better. To braze the plugs to the vane walls, the furnace is ramped up to about 1675° F.-1725° F. at a rate of approximately 30° F. per minute and held for 25 to 35 minutes. The temperature is then increased to a range of 1825° F.-1875° F. and held for 10 to 15 minutes. Preferably, when the temperature exceeds 1700° F., 100-300 microns of argon are added. The assemblies are then fast-cooled with the argon within the furnace to 175° F. or below and removed from the furnace. The nozzle assemblies may then be tested for leaks. For example, a pressure test fixture, not shown, may be applied to the nozzle assembly to apply approximately 50 pounds per square inch of pressure which is held for five minutes. Water is then applied to the braze joints, or the assembly is immersed in a water tank, to check for bubbles which would indicate leaks. Assuming the absence of leaks, the nozzle assemblies are dried and the plugs are rebrazed. For example, the assemblies are again disposed in a furnace which is then evacuated to a vacuum of about $5\times10^{-4}$ Torr or better. To complete the furnace brazing, the furnace is ramped up to a temperature of between 1675° F.-1725° F. at a rate of 30° F. per minute and held for 25 to 35 minutes. The temperature is then increased to a range between 1825° F.-1875° F. and held for 10 to 15 minutes. As the temperature exceeds 1700° F., 100-300 microns of argon are added and the nozzle assemblies are fast-cooled with the argon to about 175° F. or below. Upon removal of the assemblies from the furnace, the assemblies are leak tested are once again similarly as above noted.

The assemblies are then tempered. For example, the assemblies are again placed in a furnace, and the furnace is evacuated to a vacuum of $5\times10^{-4}$ Torr or better. The assemblies are heated to approximately 1050° F.-1125° F. for about four hours. The assemblies are then cooled in the furnace to below 200° F. before removing from the furnace.

Finally, holes are now formed in the walls of the vanes, particularly through the brazed plugs. It will be appreciated that the new holes formed through the plugs may be larger in area e.g. diameter relative to the existing holes 32 and 34. Typically, however, the new holes are provided with a smaller area e.g. a smaller diameter, relative to the existing holes 32 and 34. Preferably, using electro-discharge machining methods are used to form holes through plugs 52, 54, 56 and 58 of a smaller size, e.g., a smaller diameter than the original existing size, e.g., diameters, of the holes. Thus, holes 60, 62 and 64 are formed through respective plugs 52, 54 and 56. Note particularly that a smaller sized diameter hole is not formed through plug 58. Accordingly, holes 60, 62 are formed through plugs 52, 54, respectively in side wall 30 while hole 64 is formed through plug 56 in side wall 31. The brazed plug 58 seals the previously formed opening 44 formed by the EDM process in side wall 31. Also note that the openings through the one side wall 30 are angled preferably about 5° relative to a tangent through the openings. The opening 64 through the opposite side wall 31 lies on the tangent and is not angled.

Following the formation of the smaller diameter holes by the EDM process, the assemblies are degreased, rinsed, air-dried and dried in an oven similarly as previously described. The old but preferably a new inlet flow conditioner 13 is then cleaned and weld prepped for attachment to the returned fuel nozzle assembly. For example, the two halves of the new inlet flow conditioner are welded along a horizontal line of symmetry as well as circumferentially. Typical welding procedures are followed including inspection and fluorescent penetration inspection.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a fuel nozzle assembly for a gas turbine having a plurality of circumferentially spaced vanes with holes through walls of the vanes for flowing fuel for premixing with air within the nozzle assembly, a method of tuning the fuel nozzle assembly by changing existing areas of the premix fuel holes in the vane walls comprising the steps of:

(a) reforming the existing holes to predetermined areas different than the existing areas;

(b) inserting plugs into the reformed holes of predetermined areas;

(c) securing the plugs to the vane walls; and (d) forming holes through a selected number of the plugs to areas less than the predetermined areas of said plugs and different than the existing areas of the premix fuel holes.

2. A method according to claim 1 wherein the step of reforming includes electro-discharge machining the existing holes to larger areas than the existing areas of the fuel holes.

3. A method according to claim 2 including reaming the reformed holes to selected diameters.

4. A method according to claim 1 including performing steps (a)-(d) sequentially, prior to step (a), removing an inlet flow conditioner from about the nozzle assembly to obtain access to the nozzle assembly and subsequent to step (d), installing the removed or a new inlet flow conditioner about the nozzle assembly.

5. A method according to claim 1 wherein the existing holes include a pair of holes in a first wall of each vane and at least one hole in a second wall of each vane opposite said first wall, and step (a) includes reforming the holes in the first wall by enlarging the areas of said pair of holes and forming a second pair of holes through said second wall with one of said holes of said second pair thereof having a larger area than and taking the place of the area of said at least one hole of said second wall.

6. A method according to claim 5 including forming the holes of each pair thereof to a common area.

7. A method according to claim 5 including forming holes through a pair of said plugs in said first wall and forming a hole through one of said plugs in said second wall, leaving said second plug in said second wall without a hole.

8. A method according to claim 1 wherein step (c) includes brazing the plugs to the walls of the vanes.

9. A method according to claim 8 wherein step (c) includes twice brazing the plugs to the vanes and performing a leak test between the two brazing steps.

10. A method according to claim 1 wherein step (d) is performed by electro-discharge machining.

11. In a fuel nozzle assembly for a gas turbine having a plurality of circumferentially spaced vanes with holes through walls of the vanes for flowing fuel for premixing with air within the nozzle assembly, a method of tuning the fuel nozzle assembly by changing the diameter of the premix fuel holes in the vane walls comprising the steps of:

(a) reforming the existing holes to a predetermined areas different than the existing diameter;

(b) inserting plugs into the reformed holes of predetermined areas;

(c) securing the plugs to the vane walls; and (d) forming holes through a selected number of the plugs to diameters less than the diameters of said existing holes.

12. A method according to claim 11 wherein the step of reforming includes electro-discharge machining the existing holes to larger diameters.

13. A method according to claim 12 including reaming the reformed holes to selected diameters.

14. A method according to claim 11 including performing steps (a)-(d) sequentially, prior to step (a), removing an inlet flow conditioner from about the nozzle assembly to obtain access to the nozzle assembly and subsequent to step (d), installing the removed or a new inlet flow conditioner about the nozzle assembly.

15. A method according to claim 11 wherein the existing holes include a pair of holes in a first wall of each vane and at least one hole in a second wall of each vane opposite said first wall, and step (a) includes reforming the holes in the first wall by enlarging the diameters of said pair of holes and forming a second pair of holes through said second wall with one of said holes of said second pair thereof being larger than and taking the place of said at least one hole of said second wall.

16. A method according to claim 15 including forming the holes of each pair thereof to a common diameter.

17. A method according to claim 15 including forming holes through a pair of said plugs in said first wall and forming a hole through one of said plugs in said second wall, leaving said second plug in said second wall without a hole.

18. A method according to claim 11 wherein step (c) includes brazing the plugs to the walls of the vanes.

19. A method according to claim 18 wherein step (c) includes twice brazing the plugs to the vanes and performing a leak test between the two brazing steps.

20. A method according to claim 11 wherein step (d) is performed by electro-discharge machining.

* * * * *